US007549299B2

(12) United States Patent
Kolb Filho et al.

(10) Patent No.: US 7,549,299 B2
(45) Date of Patent: Jun. 23, 2009

(54) WATER RESERVOIR FOR A REFRIGERATOR

(75) Inventors: Ricardo Kolb Filho, Joinville - SC (BR); Rodolfo Floeter Júnior, Joinville - SC (BR); Claiton Emílio do Amaral, Joinville -SC (BR); Edson Isaltino Bento, Joinville -SC (BR)

(73) Assignee: Whirlpool S.A., Sao Paulo (BR)

( * ) Notice: Subject to any disclaimer, the term of this patent is extended or adjusted under 35 U.S.C. 154(b) by 350 days.

(21) Appl. No.: 10/557,277

(22) PCT Filed: Jun. 9, 2004

(86) PCT No.: PCT/BR2004/000087

§ 371 (c)(1),
(2), (4) Date: Aug. 16, 2006

(87) PCT Pub. No.: WO2004/109204

PCT Pub. Date: Dec. 16, 2004

(65) Prior Publication Data

US 2007/0089452 A1 Apr. 26, 2007

(30) Foreign Application Priority Data

Aug. 11, 2003 (BR) ..... 0302286

(51) Int. Cl.
*F25D 23/12* (2006.01)

(52) U.S. Cl. ..... 62/338; 62/389; 220/254.1; 222/146.6; 312/405

(58) Field of Classification Search ..... 62/338–339, 62/389; 220/254.1, 254.7; 222/129.1, 145.1, 222/146.6; 312/321.5, 405.1
See application file for complete search history.

(56) References Cited

U.S. PATENT DOCUMENTS 1,899,578 A * 2/1933 Lindsay ..... 222/130

(Continued)

FOREIGN PATENT DOCUMENTS

DE 94 12 239 U1 9/1994

(Continued)

OTHER PUBLICATIONS

Patent Abstracts of Japan, vol. 2002, No. 08, Aug. 5, 2002 & JP 2002 115960 A (Hitachi Ltd; Hitachi Consumer Products Ltd), Apr. 19, 2002.

*Primary Examiner*—William E Tapolcai
(74) *Attorney, Agent, or Firm*—Darby & Darby P.C.

(57) ABSTRACT

A water reservoir for a refrigerator having a refrigerating compartment provided with a front door having an internal panel in which shelves and a water reservoir are removably affixed. The front door having an external face carrying a dispensing valve supplied by the water reservoir. The recipient is superiorly opened and removably affixed to the internal panel of the door between the fixation positions of two consecutive shelves, and incorporates a lower outlet nozzle projecting through the door so as to be maintained in fluid communication with the dispensing valve. The reservoir including a lid removably fitted onto the recipient and provided with an opening; and an over-lid provided with a window and mounted to the lid, in order to be selectively and manually displaced in a plane parallel and adjacent to the mounting plane of the lid between an open position, in which its window is aligned with the opening of the lid and a closed position, in which the opening of the lid is blocked by the over-lid.

8 Claims, 6 Drawing Sheets

U.S. PATENT DOCUMENTS 2,408,704 A * 10/1946 Taylor ..... 222/160
3,024,621 A 3/1962 Parker
4,274,563 A 6/1981 Otterson
4,801,182 A * 1/1989 Metcalfe et al. ..... 312/321.5
5,193,892 A * 3/1993 Swindell ..... 312/405.1
5,813,246 A * 9/1998 Oh ..... 62/391
5,971,213 A * 10/1999 Lee ..... 222/146.6
6,003,734 A * 12/1999 Oh ..... 222/146.6
6,574,984 B1 * 6/2003 McCrea et al. ..... 62/449
D496,056 S * 9/2004 Floeter et al. ..... D15/89

FOREIGN PATENT DOCUMENTS

FR 2 543 127 A3 9/1984
WO WO-03/046451 A1 6/2003

* cited by examiner

WATER RESERVOIR FOR A REFRIGERATOR

CROSS REFERENCE TO PRIOR APPLICATION

This is a U.S. national phase application under 35 U.S.C. §371 of International Patent Application No. PCT/BR2004/000087, filed Jun. 9, 2004, and claims benefit of Brazilian Patent Application No. PI 0302286-2, filed Jun. 11, 2003 which is incorporated by reference herein. The International Application was published in English on Dec. 16, 2004 as WO 2004/109204 A1 under PCT Article 21(2).

FIELD OF THE INVENTION

The present invention refers to a water reservoir to be mounted to the internal panel of a refrigerator door, in order to refrigerate the load of water stored therein and to allow its gravitational release to a tap or dispensing valve which is accessed by the external face of the door, allowing the user to take water from the reservoir without having to open the refrigerator door.

PRIOR ART

There are well known from the art different constructions for a water reservoir to be mounted close to the internal panel of a front door of a refrigerating compartment of a refrigerating appliance, such as a single or combined refrigerator. The prior art mounting arrangements use a reservoir presenting generally parallelepipedic configurations with a relatively large height and occupying a large space in the region of the internal panel of the door, which reduces the useful volume for storing several products on the shelves usually affixed to said internal panel of the door, besides causing a modification in the design of these door shelves, requiring the extension of one or more of said shelves to be reduced for mounting the reservoir, and impairing the storage capacity of the refrigerating compartment as a whole, considering that the door shelves also define a storage volume contained in the same refrigerating ambient.

However, these known constructions require relatively complex configurations and mounting elements for allowing the water reservoir to be accommodated in the internal panel of the door, increasing the cost of the end product and considerably limiting the storage capacity thereof. In other words, the solutions for a water reservoir in a refrigerator door have prioritized the provision of a water reservoir to be maintained refrigerated, without much concern given to the storage volumetric capacity of said refrigerating compartment in the region adjacent to the internal panel of the front door.

Another disadvantage of the presently known water reservoirs is related to the difficulty in providing an effective cleaning of its interior after a determined time of use has elapsed, since such reservoirs generally take the form of a recipient obtained by blow molding and whose interior can only be accessed through a water refill nozzle whose dimensions are insufficient to allow accessing the interior of the recipient for cleaning operations. Even when the recipient is superiorly provided with a lid defining its upper wall, the construction requires, for refilling the load of water, the lid to be completely or partially moved upwardly, generally by angular displacement, which requires the water reservoir to be removed from the door in order to be refilled, or positioning said reservoir with a certain spacing in relation to any obstacle, such as the bottom of a shelf disposed immediately above, in order to provide a gap for moving the lid without interfering with other parts of the front door.

A further deficiency of the known constructions results from the fact that the housing provided in the internal panel of the door to receive said reservoir is configured to specifically lodge the reservoir. Consequently, in the inexistence of the reservoir, said mounting space remains useless, i.e., not used in association with any of the shelves usually provided in the internal panel of the door.

The prior art constructions presenting the deficiencies mentioned above can be found, for example in the patent documents U.S. Pat. No. 5,683,015; JP 08285732; U.S. Pat. No. 5,813,246; JP 20009284.

OBJECTS OF THE INVENTION

By reason of the disadvantages mentioned above, it is a generic object of the present invention to provide a water reservoir to be removably fitted in the internal panel of a refrigerator door, in order to occupy only a reduced portion of the storage volume defined between a pair of consecutive shelves close to the bottom of the upper shelf of said pair.

It is a complementary object of the present invention to provide a water reservoir such as mentioned above, which allows for an extremely easy water refill operation, with no need of removing the reservoir or displacing the reservoir itself or any other accessory incorporated to said internal panel of the door.

It is further object of the present invention to provide a water reservoir such as defined above, which is able to be completely, internally and easily submitted to cleaning operations when detached from its fixation position in the internal panel of the door.

It is still a further object of the invention to provide a water reservoir such as defined above and which, when detached from the internal panel of the refrigerator door, can have its mounting place occupied by another accessory to be removably affixed to said internal panel.

SUMMARY OF THE INVENTION

The present invention refers to a water reservoir to be applied to a refrigerator which comprises a refrigerating compartment provided with a front door having an internal panel, in which shelves and a water reservoir are removably affixed, said front door having an external face carrying a dispensing valve which is supplied by the water reservoir.

According to the invention, the reservoir comprises a recipient superiorly opened and removably affixed to the internal panel of the door between the fixation positions of two consecutive shelves, and which incorporates a lower outlet nozzle projecting through the door in order to be maintained in fluid communication with the dispensing valve, said reservoir further comprising a lid removably fitted into the recipient and which is provided with an opening; and an over-lid provided with a window and which is mounted to the lid, so as to be selectively and manually displaced in a plane parallel and adjacent to the mounting plane of the lid between an open position, in which its window is aligned with the opening of the lid, and a closed position in which the opening of the lid is blocked by the over-lid.

The above-defined construction allows obtaining a reservoir which can be easily adapted to the internal panel of a front door of a refrigerator occupying only a reduced portion of the storage volume defined between a pair of consecutive shelves and internal to said front door, which reservoir can be filled with a load of water with no need of being displaced from its mounting position.

BRIEF DESCRIPTION OF THE DRAWINGS

The invention will be described below, with reference to the enclosed drawings, given by way of example of a possible embodiment to the invention and in which.

DETAILED DESCRIPTION OF THE INVENTION

Figure 1:
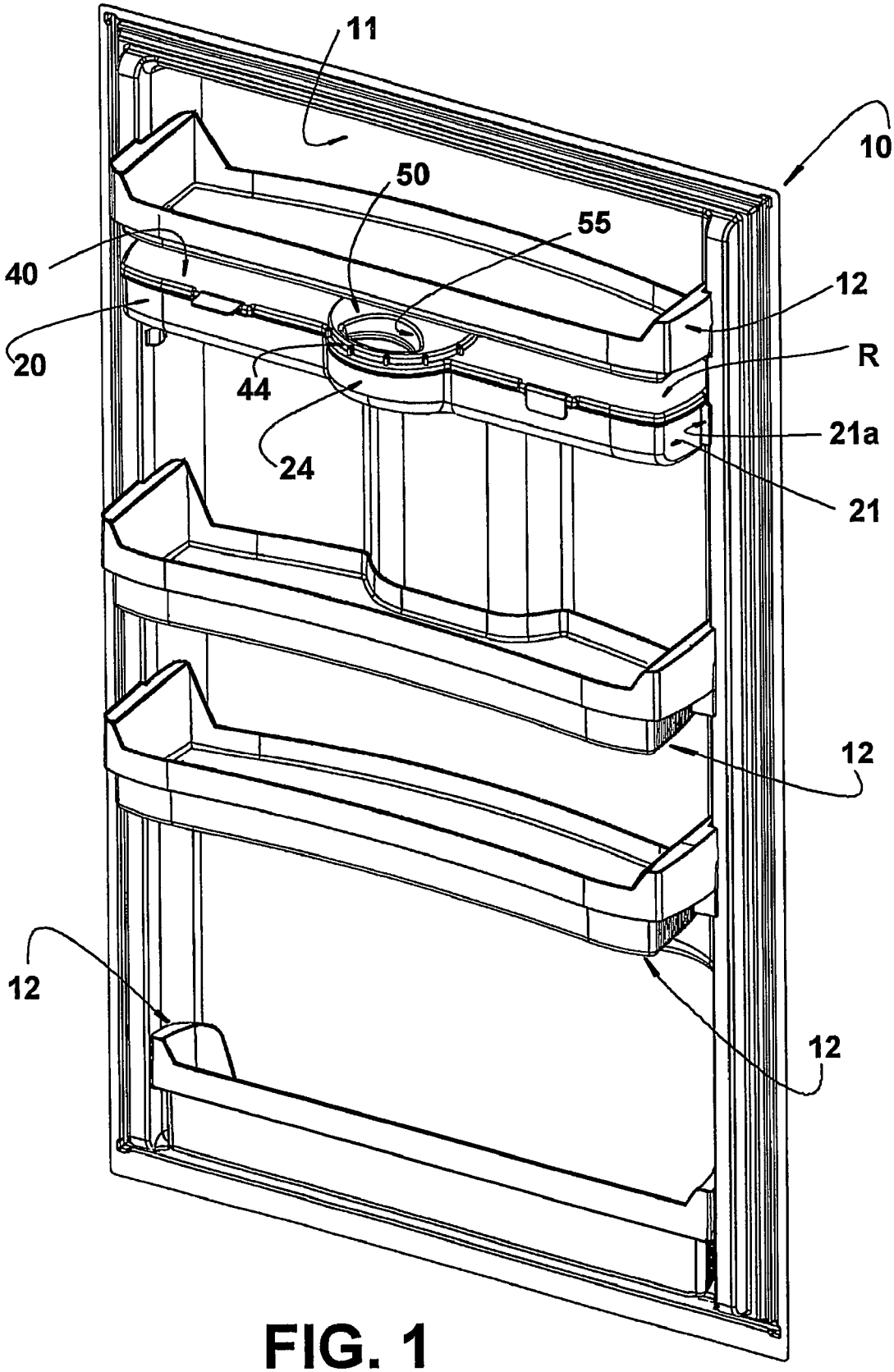
FIG. 1 is an internal perspective view of a refrigerator door carrying different shelves and also the water reservoir, according to the present invention.

The present water reservoir is designed to be removably affixed to the internal panel 11 of a front door 10 of the refrigerating compartment of a single or combined refrigerator.

The constructive solution proposed by the present invention is particularly advantageous when applied to front doors 10, whose internal panel 11 is designed to removably secure different shelves 12 which are maintained vertically spaced apart to define volumes for storing several products therebetween.

According to the proposal of the present invention, the water reservoir R comprises a recipient 20, usually of plastic material and in the form of a elongated tray, superiorly opened and which generally presents a longitudinal extension corresponding to that of the shelves 12, and end walls 21 provided with fitting means 21*a*, to be coupled to the internal panel 11 and which can have any construction well known in the art.

The recipient 20 is removably affixed to the internal panel 11 of the front door 10 in the upper region of the free gap defined between a pair of consecutive shelves 12, whereby the recipient 20 occupies a position defined immediately below the upper shelf of said pair of shelves 12. Since the recipient 20 presents a height similar to that of a shelf 12, the reservoir occupies only the upper volume of a gap between shelves, which upper volume is not completely occupied by the products stored on the lower shelf of said gap. Thus, the provision of the reservoir R does not cause any relevant loss in the storage volume made available by the shelves 12 of the front door 10.

The recipient 20 incorporates a lower outlet nozzle 22 which is configured to project through the thickness of the door 10 generally in a downwardly inclined path, so as to have a free end maintained in fluid communication with a dispensing valve 30 which is mounted close to the external face of the door 10 so as to be accessed by the user positioned in front of the refrigerator.

Figure 2:
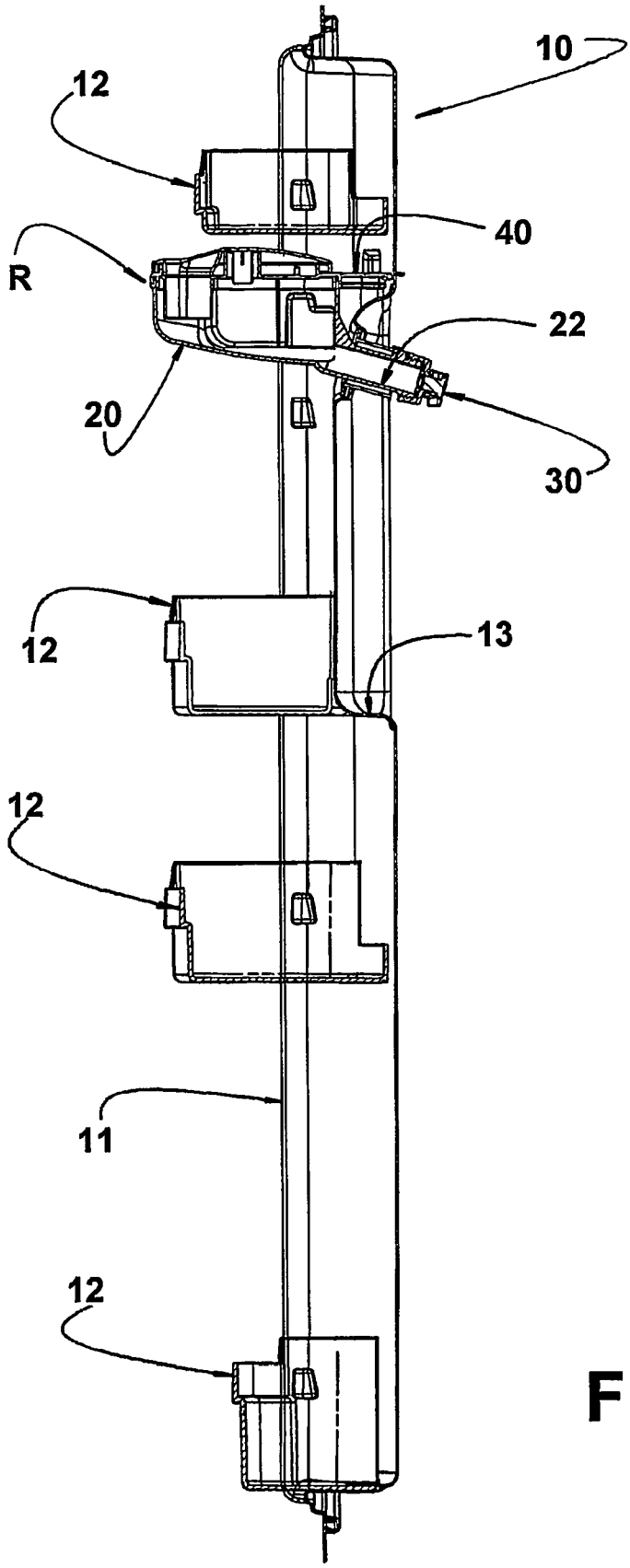
FIG. 2 is a median vertical sectional view of the door illustrated in FIG. 1.
Figure 3:
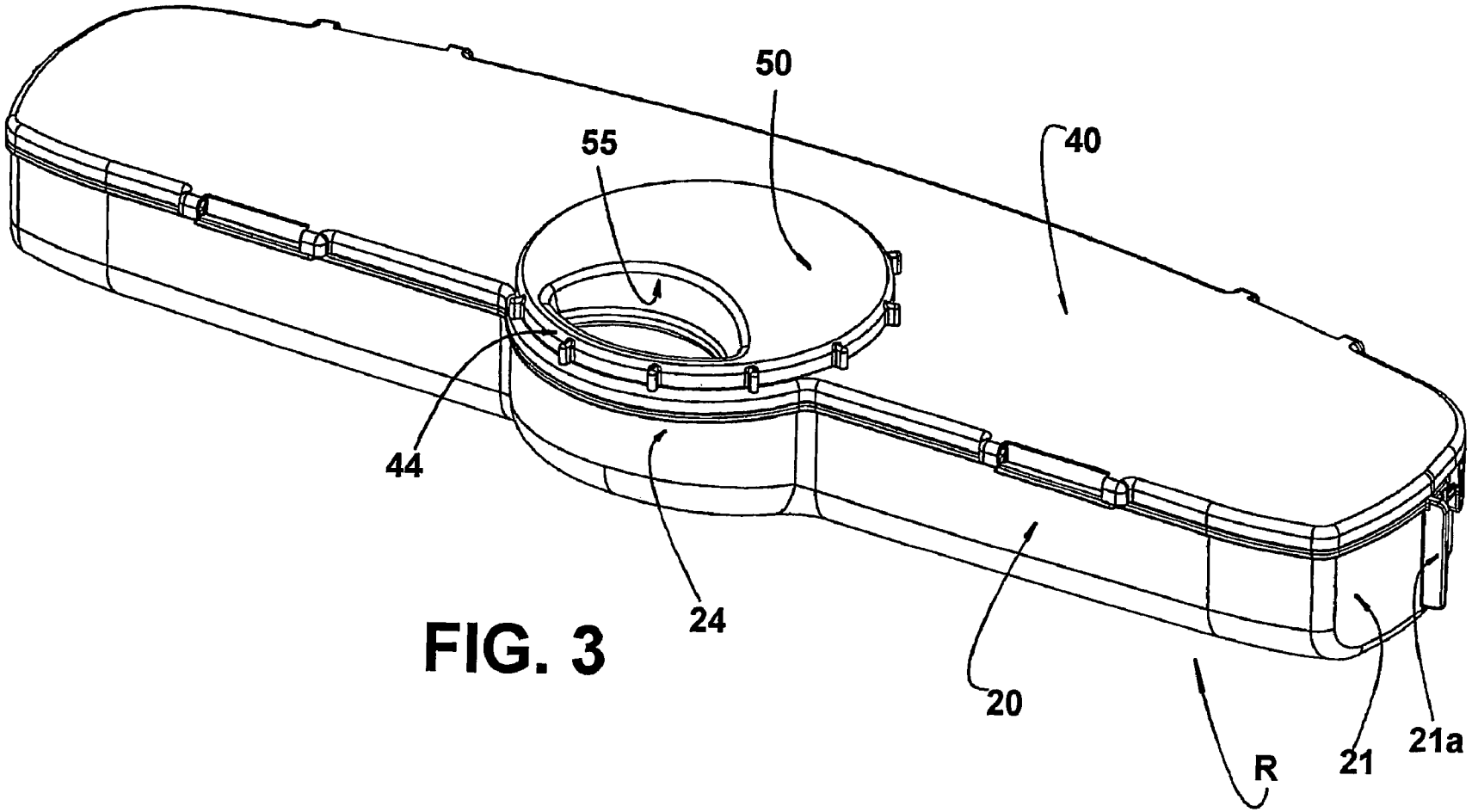
FIG. 3 is a front upper perspective view of the water reservoir of the present invention with its over-lid in the open position for water refill.
Figure 4:
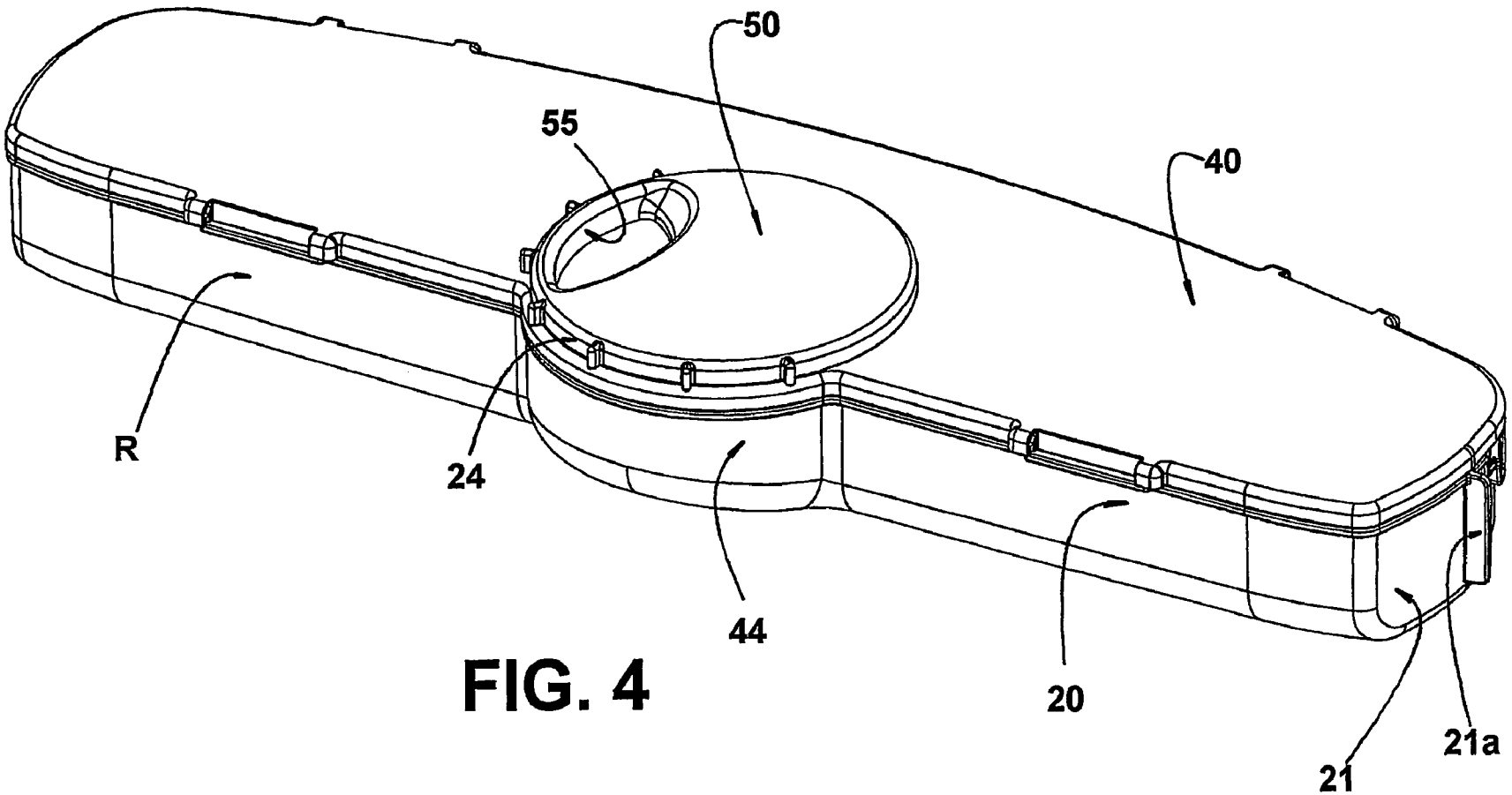
FIG. 4 is a view similar to that of FIG. 3, but illustrating the over-lid in the closed position.
Figure 5:
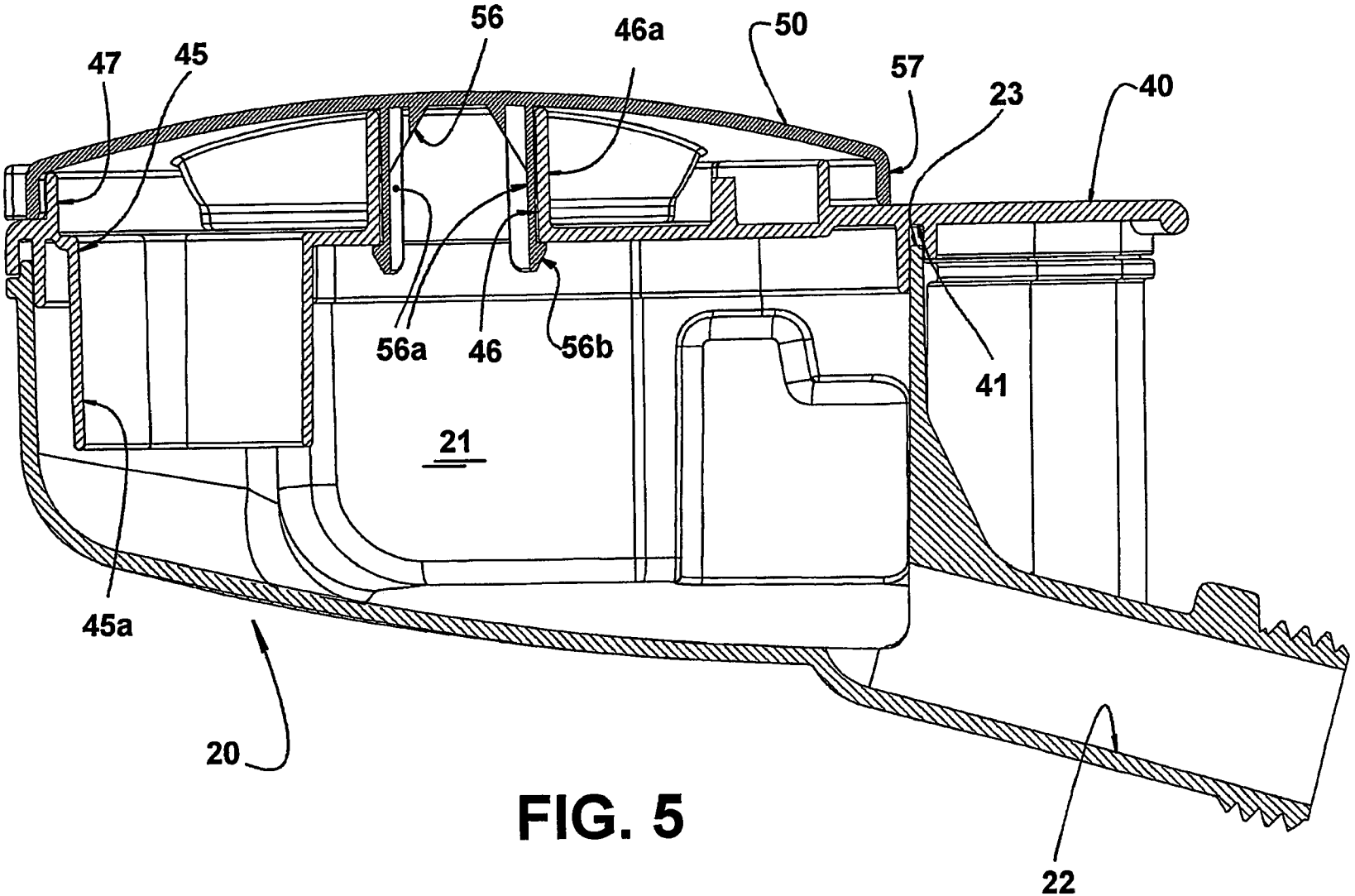
FIG. 5 is a cross-sectional view of the present water reservoir, taken so as to diametrically intersect the over-lid of the reservoir and the lower outlet nozzle.
Figure 6:
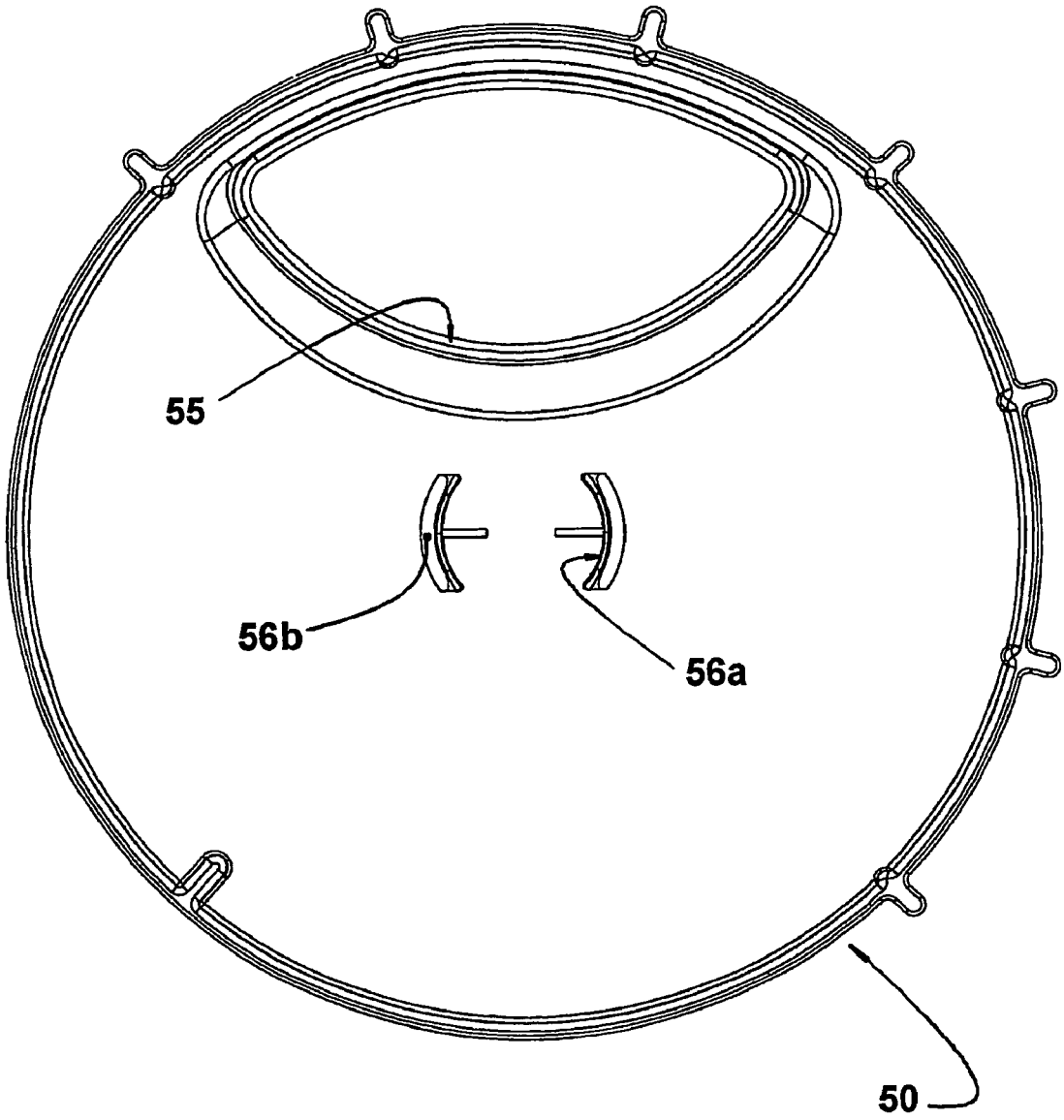
FIG. 6 is a lower plan view of the over-lid of the present water reservoir.

As better illustrated in FIG. 2, the dispensing valve 30 is preferably positioned in a recess 13, medianly provided in the external face of the front door 10 and which is dimensioned to facilitate the positioning of a water collecting recipient, such as a glass or the like, below the dispensing valve 30.

In the illustrated construction, the dispensing valve 30 is mounted to the free end of the lower outlet nozzle 22, whereby the mounting position of the reservoir R in the front door 10 is unique and previously defined in project. However, it should be understood that the dispensing valve 30 could be mounted to the outlet end of a pipe (not illustrated) internal to the front door 10 and presenting two or more inlet ends, turned to the internal panel 11 of the front door 10 and which are positioned so as to receive, for example by fitting, the free end of the lower outlet nozzle 22 of the recipient 20 when the latter is fitted in a respective mounting position in the front door 10. This construction allows the manufacturer or even the user to select the mounting position of the reservoir R in the internal panel 11 of the door 10, as a function of the operative characteristics to be required for the refrigerator.

The dispensing valve 30 can present any adequate construction, provided or not with a drive rod to be moved by the collecting recipient itself that is manually positioned below said dispensing valve 30.

The reservoir R further comprises a lid 40, also preferably constructed in a plastic material, which presents a contour corresponding to the upper contour of the recipient 20 and which is designed to be removably fitted into an upper edge 23 of the recipient 20.

In the illustrated construction, the lid 40 has the form of an inverted shallow tray, incorporating a peripheral lower rib 41 in which the upper edge 23 of the recipient 20 is removably tightly affixed, assuring the adequate and secure contention of a load of water inside the reservoir R.

Considering the preferred positioning for the reservoir R as being that inferiorly adjacent to a shelf 12, the recipient 20 incorporates an advanced front portion 24 which is dimensioned to project forwardly of the immediately upper shelf 12, the lid 40 incorporating a corresponding front region 44 forwardly projecting and which is configured to be seated on the advanced front portion 24 of the recipient 20, hermetically covering said advanced front portion 24.

The lid 40 is provided with an opening 45, defined at least partially in the front region 44 and which has its periphery incorporating an internal tubular projection 45*a* downwardly extending to the interior of the recipient 20.

The construction of both the recipient 20 and the lid 40 defined above allows the opening 45 to be at least partially projected forwardly of the immediately upper shelf 12, permitting the reservoir R to be easily refilled, with no need of being disengaged from the internal panel 11 of the front door 10, which is only necessary when internal cleaning of the reservoir R is required.

In order to maintain the reservoir R closed during its normal operation, there is provided an over-lid 50 having a window 55 and which is mounted to the lid 40 so as to be manually displaced by the user between an open position, in which it is maintained aligned with the opening 45 of the lid 40, and a closed position, in which it blocks the opening 45.

According to the invention, the reservoir R should be mounted immediately below a shelf 12, in order to occupy a reduced storage volume of the respective gap between the shelves where it is mounted. Thus, the invention provides an over-lid 50, whose displacement between the open and closed positions occurs in a plane parallel and adjacent to the mounting plane of the lid 40.

In the illustrated construction, the over-lid 50 is mounted to the lid 40, so as to remain axially retained thereto, but free to be manually rotated to its open and closed positions. The over-lid 50 presents a preferably circular contour with the window 55 eccentrically disposed, and incorporates a central lower projection 56, which is rotatively supported and axially locked in a hole 46 of the lid 40. In the illustrated constructive example, the central lower projection 56 is defined by two or more rods 56*a* in a tubular arrangement, which are fitted and rotatively supported inside an upper tubular projection 46*a* of the lid 40, through which the hole 46 of the latter is defined. The rods 56*a* are resiliently deformable in the radial direction and incorporate end teeth 56*b* seated below the lid 40 and around the hole 46 of the latter.

Still according to the illustrated embodiment, the over-lid 50 is presented in the form of a small circular tray with an externally convex bottom and which is disposed in an inverted manner, incorporating a pending peripheral skirt 57 which is telescopically mounted around a small upper tubular projection 47 of the lid 40, so as to increase the sealing degree of the over-lid 50 in relation to the lid 40.

While only one constructive form has been illustrated for the reservoir of the present invention, it should be understood that changes in the form and arrangement of the elements that form the device could be made, without departing from the constructive concept defined in the appended claims.

The invention claimed is:

1. A water reservoir for a refrigerator comprising:

a refrigerating compartment provided with a front door having an internal panel in which shelves and a water reservoir are removably affixed, said front door having an external face carrying a dispensing valve supplied by the water reservoir, comprising:

a recipient which is superiorly opened and removably affixed to the internal panel of the door within a free gap between the fixation positions of two consecutive shelves, said free gap situated immediately below the upper shelf of said two consecutive shelves, said recipient having a form of an elongated tray and a height similar to that of the shelf, incorporating a lower outlet nozzle projecting through the door so as to be maintained in fluid communication with the dispensing valve, a lid which is removably fitted onto the recipient and provided with an opening; and an over-lid which is provided with a window and mounted to the lid, in order to be selectively and manually displaced in a plane parallel and adjacent to the mounting plane of the lid between an open position, in which its window is aligned with the opening of the lid and a closed position, in which the opening of the lid is blocked by the over-lid.

2. The reservoir as set forth in claim 1, wherein the over-lid is rotatively displaced between its open and closed positions.

3. The reservoir as set forth in claim 2 wherein the over-lid incorporates a central lower projection, which is supported and axially locked in a hole of the lid.

4. The reservoir as set forth in claim 3 wherein the central lower projection of the over-lid is defined by a plurality of rods in a tubular arrangement, the hole of the lid being defined in an upper tubular projection within which the rods are fitted and rotatively supported.

5. The reservoir as set forth in claim 4, wherein the rods are resiliently deformable in the radial direction and incorporate end teeth seated below the lid around the hole thereof.

6. The reservoir as set forth in claim 1, wherein the lid incorporates, peripherally to the opening, an internal tubular projection.

7. The reservoir as set forth in claim 1, wherein the lid is presented in the form of a shallow and inverted tray, incorporating a peripheral lower rib inside which an upper edge of the recipient is tightly fitted.

8. The reservoir as set forth in claim 1, wherein the opening of the lid is provided, at least partially, in a front region of the lid forwardly projecting and configured to cover a corresponding advanced front portion of the recipient.

* * * * *

UNITED STATES PATENT AND TRADEMARK OFFICE

CERTIFICATE OF CORRECTION

PATENT NO. : 7,549,299 B2
APPLICATION NO. : 10/557277
DATED : June 23, 2009
INVENTOR(S) : Ricardo Kolb Filho It is certified that error appears in the above-identified patent and that said Letters Patent is hereby corrected as shown below:

On the Title Pg, Item (30), under Foreign Application Priority Data, please delete "Aug. 11, 2003" and insert -- June 11, 2003 -- therefore.

Signed and Sealed this

Ninth Day of March, 2010

David J. Kappos

David J. Kappos
*Director of the United States Patent and Trademark Office*